US008069595B2

(12) United States Patent
Aiezza

(10) Patent No.: US 8,069,595 B2
(45) Date of Patent: Dec. 6, 2011

(54) GARMENT CLEANLINESS INDICATOR

(76) Inventor: Michael Aiezza, Ellington, CT (US)

( * ) Notice: Subject to any disclaimer, the term of this patent is extended or adjusted under 35 U.S.C. 154(b) by 176 days.

(21) Appl. No.: 12/619,703

(22) Filed: Nov. 17, 2009

(65) Prior Publication Data

US 2011/0113659 A1 May 19, 2011

(51) Int. Cl.
*G09F 3/00* (2006.01)

(52) U.S. Cl. ..... 40/322; 116/321

(58) Field of Classification Search ..... 40/322, 40/109; 116/321, 322, 323
See application file for complete search history.

(56) References Cited

U.S. PATENT DOCUMENTS 1,381,881 A * 6/1921 Lely ..... 40/109
2,169,552 A 8/1939 Bellin
3,124,284 A * 3/1964 Collum ..... 223/98
3,633,294 A 1/1972 Burmeister
4,886,010 A * 12/1989 Stutzman ..... 116/308
5,499,466 A 3/1996 House
5,564,361 A * 10/1996 Satterwhite ..... 116/308
D430,219 S 8/2000 Chagan
6,330,969 B1 * 12/2001 Villaraut ..... 235/64.7
7,246,730 B2 * 7/2007 Russo ..... 223/85

* cited by examiner

*Primary Examiner* — Gary Hoge
(74) *Attorney, Agent, or Firm* — Dennis G. LaPointe

(57) ABSTRACT

The invention is a product that allows one to determine precisely how many times a particular garment has been worn. By removing the guesswork from the "wash-or-wear equation," the consumer knows the garment is sufficiently clean, and will generally be able to extend the wearing of the garment between cleanings. Use of the invention will result in the conservation of resources in terms of reduced consumption of water, energy, detergent/softeners, and dry cleaning services; it will also increase the life span of garments as well as cleaning/drying appliances.

5 Claims, 10 Drawing Sheets

GARMENT CLEANLINESS INDICATOR

FIELD OF THE INVENTION

The invention relates to an apparatus for use with garments to track wear and to reduce the frequency of cleanings.

BACKGROUND OF THE INVENTION

Often consumers go to their closets and are unsure as to the cleanliness of certain garments. Unable to recall how often the garment has been worn the consumer will tend to under utilize and over wash the garment. What is needed is a convenient device that serves as a "Good Steward" that promotes improved garment utilization and the conservation of resources as it relates to garments that can be worn multiple times before being cleaned. Garments for which this system is applicable include formal garments such as suites and dresses, garments worn for a short period of time, and garments worn in cool climates.

SUMMARY OF THE INVENTION

The invention is a product that allows one to determine precisely how many times a particular garment has been worn. Optional features can include indicators for the last day of use in a week. By removing the guesswork from the "wash-or-wear equation," the consumer knows the garment is sufficiently clean, and will generally be able to extend the wearing of the garment between cleanings. Use of the invention will result in the conservation of resources in terms of reduced consumption of water, energy, detergent/softeners, and dry cleaning services; it will also increase the life span of garments as well as cleaning/drying appliances.

In one embodiment, the product comprises a card or planar surface member that can be made from a plastic stock or a paper stock or similar material, with an optionally attached closed lanyard loop at the top, a strip of material formed as a string lanyard or a ribbon like or generally flat lanyard, and an optional clear plastic protective sheathing. Connected to the top of the card is a loop which is sized and configured to slip over the top of any size clothes hanger. The loop can be formed from the same material forming the strip and be made from the same continuous length of material. The strip coming down from the loop and/or near the top edge of the member and continues through an opening or aperture on top back of the card. The strip then runs down the face of the card and exits through an opening or aperture on the bottom front side of the card; and the strip extends a sufficient length such as a few inches below the bottom of the card so that a person may hold onto the depending portion to raise the card back to the initial start position or a person can slide the card down along the extended strip as the garment is worn.

The card and strip material may optionally be substantially surrounded by a taut thin plastic sheathing, which may be open on the top and bottom of the card or have appropriate apertures for attachment points and passing through the lanyard. This keeps the lanyard material taut, which is especially helpful for use with garments in drawers or shelves.

There are a number of spaced apart horizontal lines on the front face of the card. For example, there may be seven lines indicative or representative of the seven days in a week. Alternative length lines may also be used, that is, the length of each line may vary. For example, if there are seven spaced apart lines, then four may be full length lines and three may be shorter lines. At the bottom of the card below or adjacent to the first line, there is an indicia indicative of the garment being clean. It could be text such as "I'M CLEAN" imprinted on the card or it could be a symbol or both text and a symbol. Above the top line or adjacent the top line, there is an indicia indicative of the garment having sufficient use to be sent to the cleaners or washed. It could be text such as "WASH ME" or "CLEAN ME" imprinted on the card or it could be a symbol or both text and a symbol.

The strip material when formed as a generally flat material such as a ribbon like material that runs through the card should have a clearly visible mark that by default is set and reset at the bottom of the card. A slight pulling down on the card results in the effect of the mark moving up. As the mark moves up it crosses the horizontal line which will register how often the garment has been worn or the last day of the week it was worn.

As an example of how the invention would work, when a newly cleaned garment is placed on a hanger, the mark is set on "I'M CLEAN". Each time the worn garment is returned to the hanger, the consumer pulls slightly downward on the card to register this use. The downward movement of the card has the effect of the mark on the strip of ribbon like material or flat lanyard moving up one line closer to the "WASH ME" setting (on the top front of the card). When the mark reaches, "WASH ME", the garment is removed from the hanger for cleaning.

The product, which stays on the hanger, is reset by holding the card in one hand and the strip of ribbon like material or flat lanyard in the other hand and pushing the card all the way up the strip of ribbon like material or flat lanyard until the mark is set to "I'M CLEAN."

The invention can also be used with clothing and textiles that are folded and are horizontally stored or shelved such as sweaters and tablecloths. The consumer would use both hands to operate invention. The invention could be placed underneath or in between the folded garment or textile.

In making the invention, the strip of ribbon like material or flat lanyard texture and card opening could be configured to effect a sensation of resistance and release associated with pulling down on the card as one passes each horizontal line on the card. In addition, it is contemplated that where some closets or bureau draws are not well lighted, day-glow type color coating on the mark of the strip of ribbon like material or flat lanyard and the horizontal lines of the card can be provided.

One way to provide for the effect of resistance is to include features on the strip of ribbon like material of flat lanyard that has regularly spaced "raises" on the strip of ribbon like material or flat lanyard, and/or regularly spaced variation to the thickness or width of the strip of ribbon like material or flat lanyard, when passing though the holes at the top and/or the bottom of the card will result in a moderate sensation of stop and go as one pulls down on the card.

The above invention can also be covered by a film of plastic to better protect the invention.

In still another embodiment similar to that described above, the lanyard extends through the upper aperture of the card and extends along the back side of the card and out the lower aperture to the front of the card. There is a pivotable arm having two parallel members saddling the card 12 and joined at an apex 30*c* that is pivotably attached near a side edge of the card 12 near the middle of a vertical length of the card 12. The back side arm, typically near the tip of the arm, is attached at an intermediate location along the lanyard portion running down the back side of the card. As the card is pulled down, the arms move up and vice-versa. The arm on the front face of the card points to the indicia on the card similar to the indicia described in the aforementioned embodiment above. The indicia can be optionally located to form a half-moon dial face if desired.

In another embodiment similar to those described above, the garment clean indicator comprises a planar member, with a loop formed from a lanyard attached near the upper edge of the planar member. The formed loop is for use in hanging the device from a hanger; an arm being pivotable attached to the planar member and manually operable; and as above, the planar member has garment worn indicia thereon representative of number of times a garment associated with the garment clean indicator has been worn, has garment cleaning needed indicia near the top edge representatively communicating to a user that said associated garment is ready to be cleaned and further has cleaned garment indicia near the bottom edge representatively communicating to the user that the associated garment is clean and ready for wear. The pivotable arm serves as a means for indicating a wear status of the garment by being manually turned to point to a desired indicia.

If a protective plastic sheathing is used, the manual operation of the pivoting arm is simply done by manually moving the small segment of the arm on the other side of the pivot point from a segment opening in the side of the protective sheathing.

In another embodiment of the present invention, the garment clean indicator comprises a planar member having a loop formed from a lanyard attached near an upper edge of the planar member for use in hanging said device from a hangar. The planar member has a notched portion along an intermediate side edge location of said planar member. A circular dial face overlies a front side surface of the planar member and rotatably attaches at a center of the dial face to the planar member. The dial face is manually operable by rotating it. The dial face has garment worn indicia thereon representative of number of times a garment associated with the garment clean indicator has been worn, has garment cleaning needed indicia representatively communicating to a user that the associated garment is ready to be cleaned and further has cleaned garment indicia representatively communicating to the user that the associated garment is clean and ready for wear. The rotatable dial face serves as a means for indicating a wear status of the garment by being manually turned to point a desired indicia toward a reference mark. The dial face may be configured to underlie the card and in that case the dial face can be manually rotated to allow for a visual observation of a desired indicia in a window or notched area.

If a protective plastic sheathing is used, the manual operation of the pivoting dial face is simply done by manually moving the outer edge of the dial face extending within the area of the notched portion and having that extended part of the dial face protrude somewhat through an opening in the side of the protective sheathing.

In another embodiment, the card is stationary and the lanyard or ribbon is a continuous loop ribbon that is snaked through the upper and lower apertures of the card with an reference mark on the lanyard of ribbon that aligns with the appropriate indicia.

DETAILED DESCRIPTION OF THE INVENTION

Figure 1A:
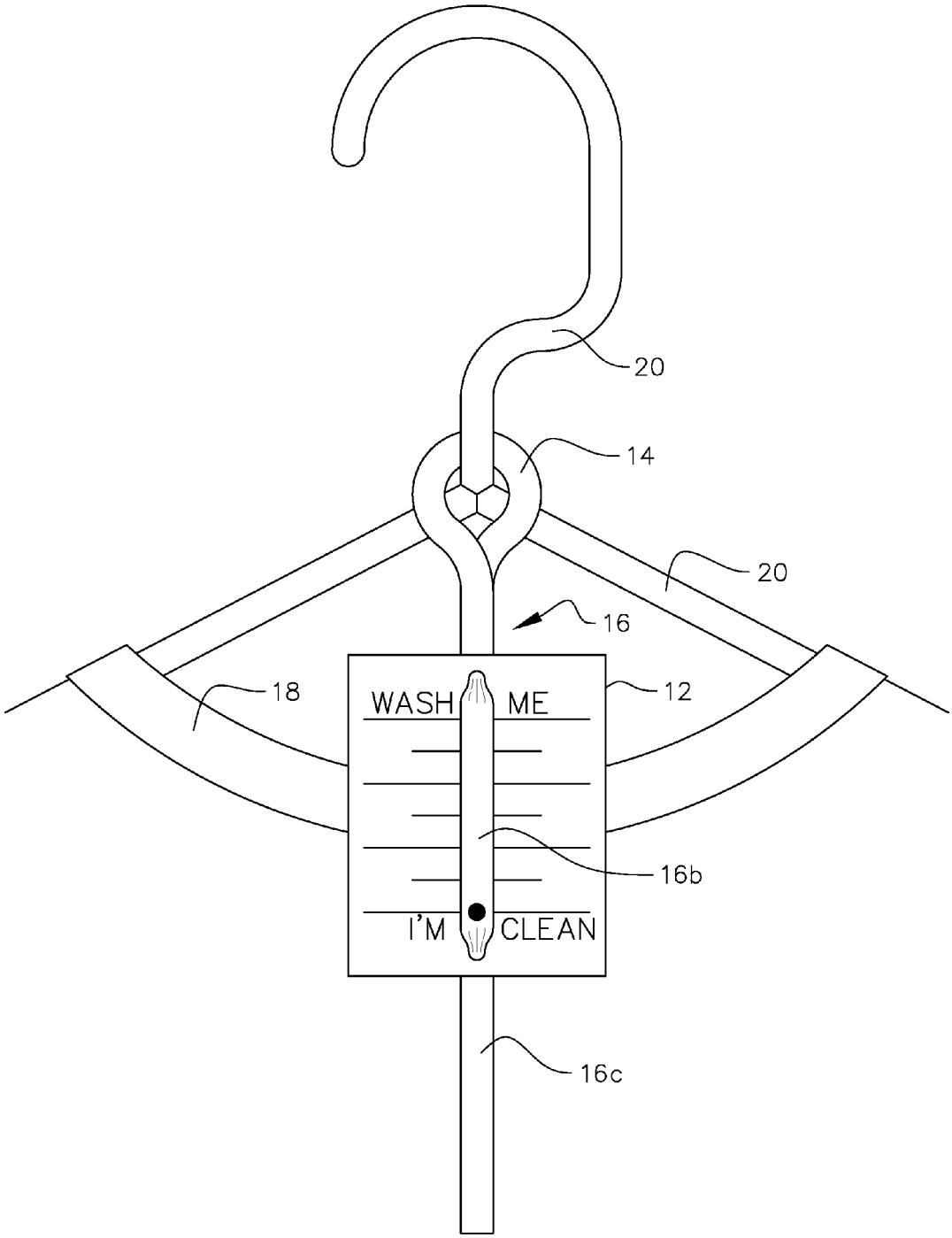
FIG. 1A is a front view of one example of the present invention in use with an associated garment and hanger.
Figure 1B:
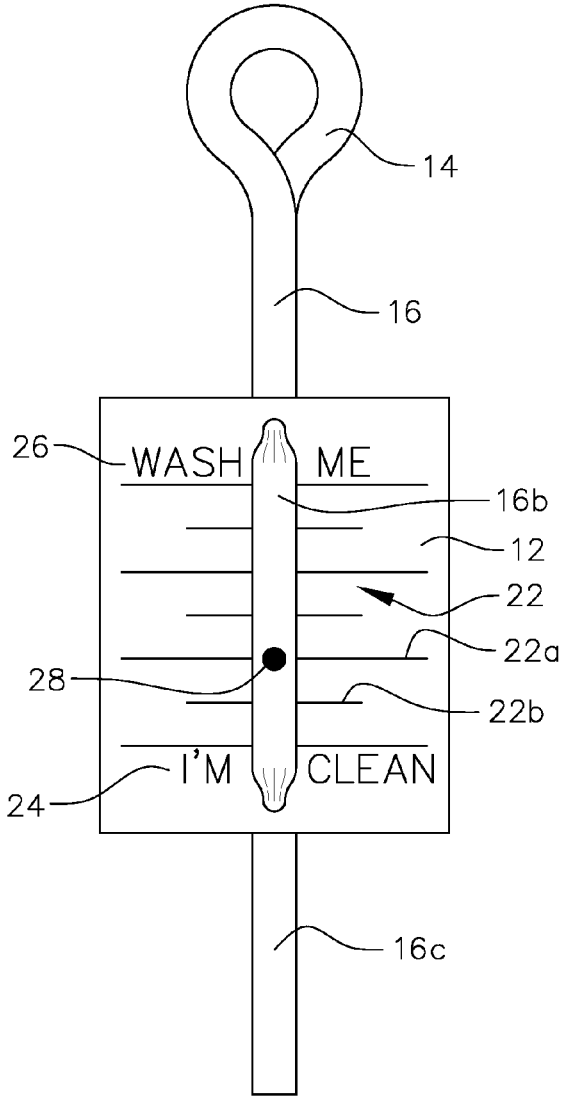
FIG. 1B is a depiction of the embodiment depicted in FIG. 1A with the mark indicating three uses or last used on the third day of the week.
Figure 1C:
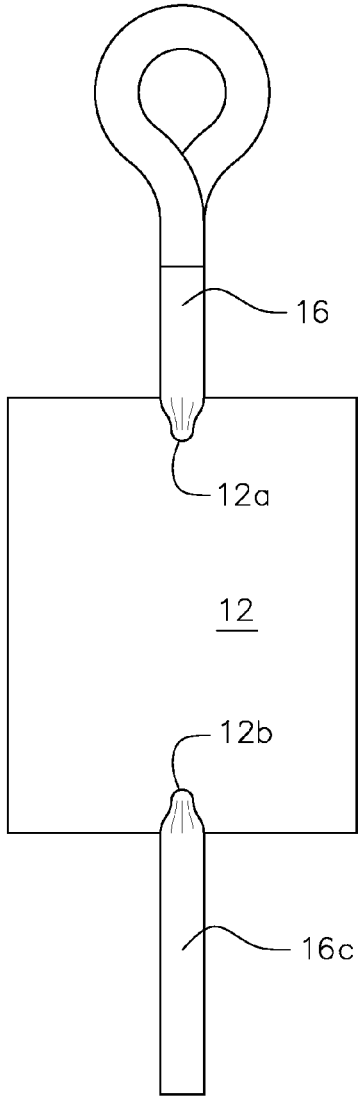
FIG. 1C is a depiction of the back side of the embodiment of FIG. 1B.
Figure 1D:
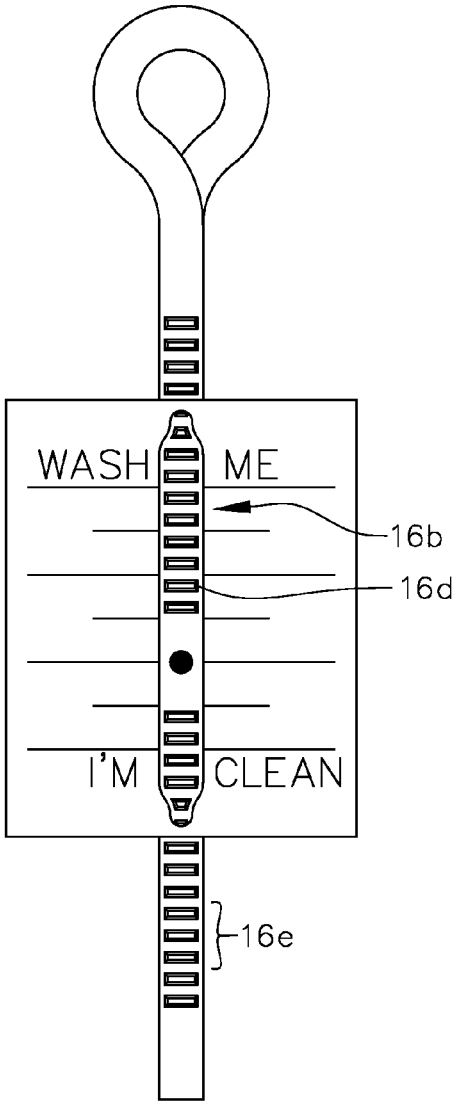
FIG. 1D is a depiction of an example of providing spaced-apart raised or thickened portions on the lanyard.
Figure 1E:
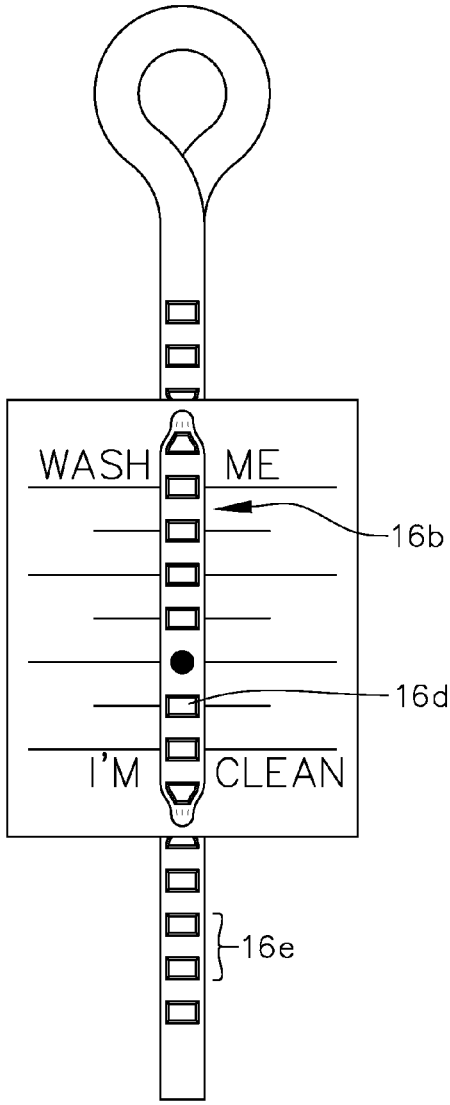
FIG. 1E is a depiction of another example of providing spaced-apart raised or thickened portions on the lanyard.
Figure 1F:
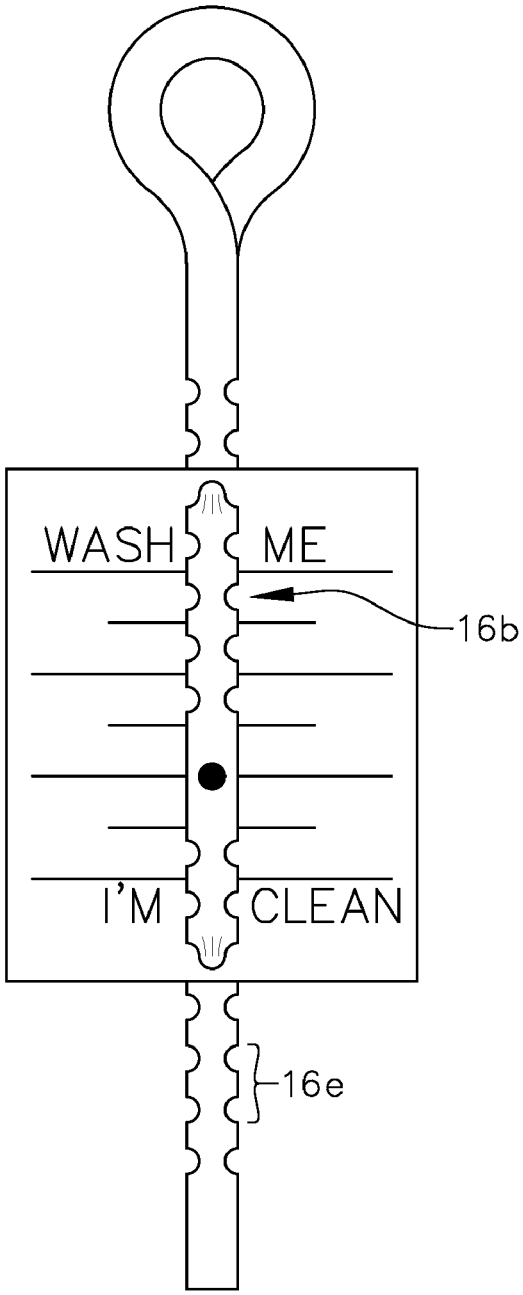
FIG. 1F is a depiction of an example of providing variable width portions on the lanyard.
Figure 2A:
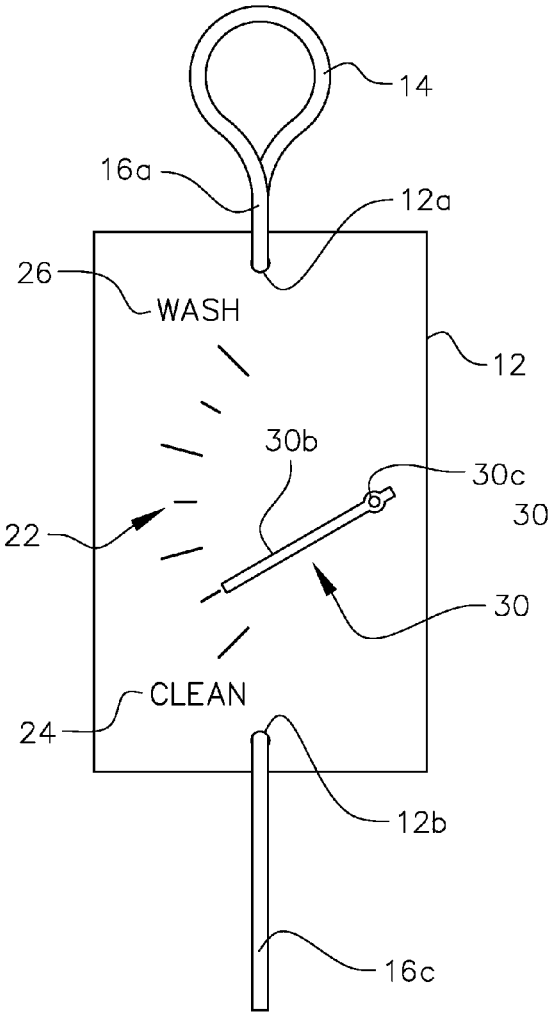
FIG. 2A is a depiction by way of example only of another embodiment of the invention using a dial in mechanical communication with the string and further showing an already worn indication.
Figure 2B:
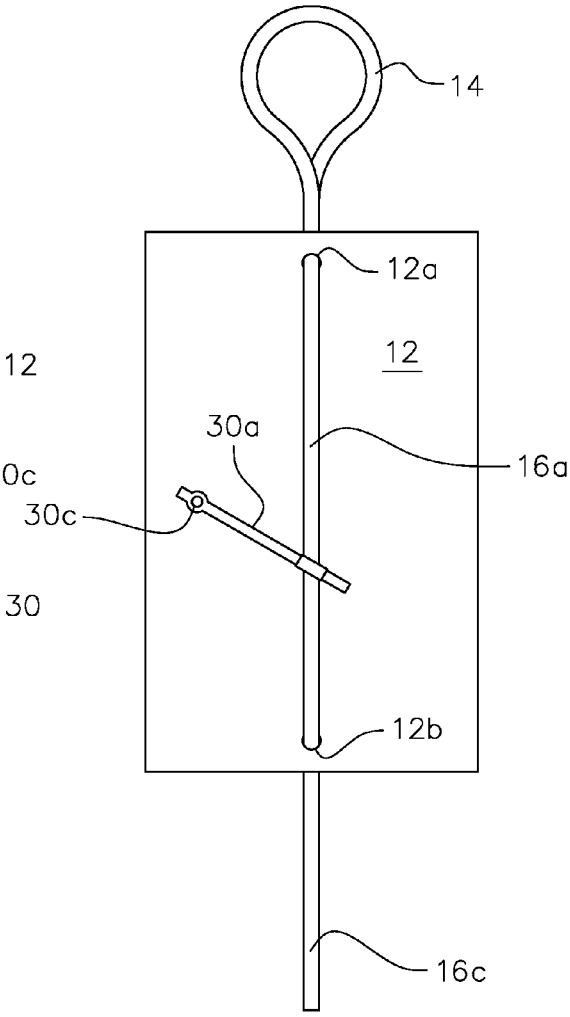
FIG. 2B is a depiction of the back side of FIG. 2A.
Figure 2C:
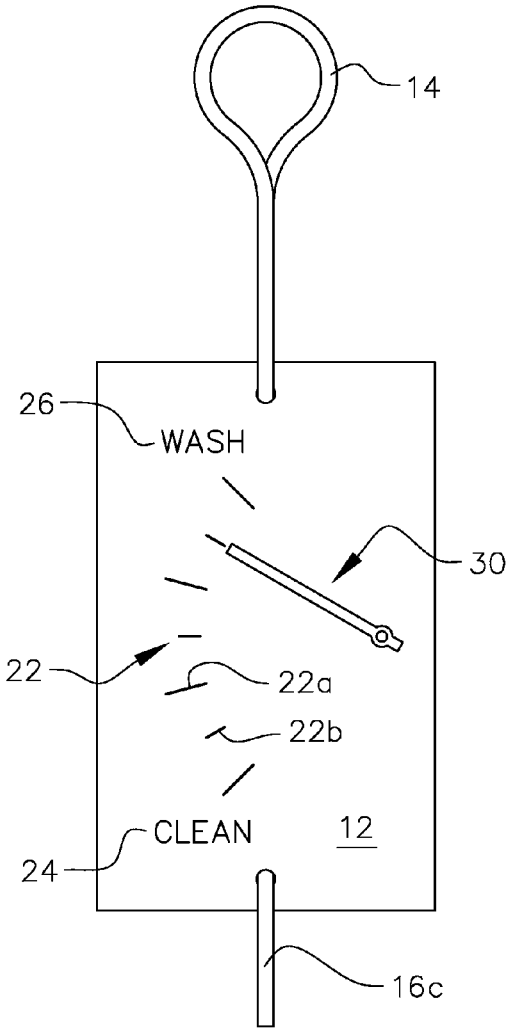
FIG. 2C is a depiction of FIG. 2A showing an indication that the garment has been worn four more times or at a later day of the week.
Figure 2D:
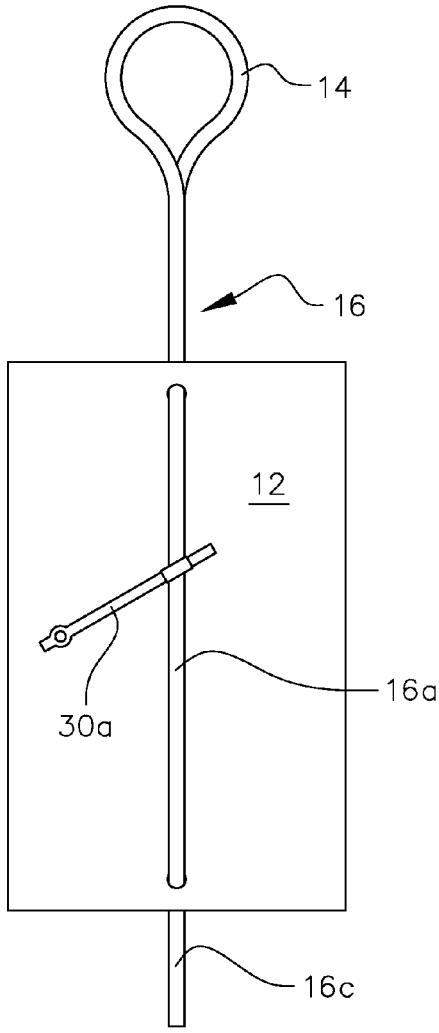
FIG. 2D is a depiction of the back side of the FIG. 2C.

Referring now to the accompanying drawings that disclose various embodiments of the present invention, which is a garment clean indicator.

In the first embodiment generally depicted as representative or example only in FIGS. 1A-1F, the product or invention comprises a card or planar surface member 12 that can be made from a plastic stock or a paper stock or similar material, with an optional attached closed lanyard loop portion 14 at the top, and a lanyard strip 16 of material formed as a string lanyard 16*a* (like that shown in FIGS. 2A-2D) or a ribbon like or generally flat lanyard 16*b*. An optional clear plastic protective sheathing (not shown) may be included to protect the invention. Loop 14 can be formed at the top of the card 12. Loop 14 is sized and configured to slip over the top of any size clothes hanger 20. Loop 14 can be formed from the same material forming the strip and be made from the same continuous length of material. The strip 16 coming down from the loop 14 or near the loop 14 continues through an opening 12*a* on top of the card 12 and runs down the face of the card 12 and exits through an opening 12*b* on the bottom front side of the card 12. Strip 16 extends a sufficient length such as a few inches below the bottom of the card 12 so that a person may hold onto the depending portion 16*c* to raise the card 12 back to the initial start position or a person can slide the card 12 down along the extended strip 16*c* as the garment 18 is worn.

As mentioned above, the card and strip material may optionally be substantially surrounded by a taut thin plastic sheathing, which may be open on the top and bottom of the card 12 or have appropriate apertures for attachment points and lanyard pass-throughs. This keeps the lanyard 16 material taut, which is especially helpful for use with garments 18 in drawers or shelves.

There are a number of spaced apart horizontal lines 22 on the front face of the card 12 that represent garment worn indicia. For example, there may be seven lines 22 indicative or representative of the seven days in a week. Alternative length lines may also be used, that is, the length of each line may vary. For example, if there are seven spaced apart lines 22, then four may be full length lines 22*a* and three may be shorter lines 22*b*. At the bottom of the card 12 below or adjacent to the first line 22, there is an indicia indicative of the garment 18 being clean or "garment clean" indicia 24. It could be text such as "I'M CLEAN" imprinted on the card or it could be a symbol or both text and a symbol. Above the top line 22 or adjacent the top line 22, there is an indicia indicative of the garment having sufficient use to be sent to the cleaners or washed or "garment cleaning needed" indicia 26. It could be text such as "WASH ME" or "CLEAN ME" imprinted on the card or it could be a symbol or both text and a symbol. The lines 22 can be representative of the number of times a garment 18 has been worn or indicative of the last day worn.

The strip material when formed as a generally flat material such as a ribbon like material that runs through the card should have a clearly visible mark 28 like a Dot (shown in the drawings by example only), Arrow Symbol, or Horizontal Line, or any such similar equivalent indicator marking that by default is set and reset at the bottom of the card 12. Mark 28 serves as means for indicating the wear status of the associated garment. A slight pulling down on the card 12 results in the effect of the mark 28 moving up. As the mark 28 moves up it crosses one of the horizontal lines 22 which will register how often the garment has been worn or the last day of the week it was worn.

As an example of how the invention would work when a newly cleaned garment 18 is placed on a hanger 20, the mark is set on "I'M CLEAN". Each time the worn garment 18 is returned to the hanger 20, the consumer pulls slightly downward on the card 12 to register this use. The downward movement of the card has the effect of the mark 28 on the strip 16 of ribbon like material or flat lanyard moving up one line closer to the "WASH ME" setting (on the top front of the card 12). When the mark 28 reaches, "WASH ME", the garment is removed from the hanger 20 for cleaning.

The product, which stays on the hanger 20, is reset by holding the card 12 in one hand and the strip 16*c* of ribbon like material or flat lanyard in the other hand and pushing the card 12 all the way up the strip 16*b* of ribbon like material or flat lanyard until the mark is set to "I'M CLEAN."

The invention can also be used with clothing and textiles that are folded and horizontally stored or shelved such as sweaters and tablecloths. The consumer would use both hands to operate invention. The invention could be placed underneath or in between the folded garment 18.

In making the invention, the strip 16*b* of ribbon like material or flat lanyard texture and card opening could be configured to effect a sensation of resistance and release associated with pulling down on the card as one passes each or some of the horizontal line 22 on the card 12. In addition, it is contemplated that where some closets or bureau draws are not well lighted, day-glow type color coating on the mark 28 of the strip 16*b* of ribbon like material or flat lanyard and the horizontal lines 22 of the card can be provided.

One way to provide for the effect of resistance is to include features on the strip 16*b* of ribbon like material of flat lanyard that has regularly spaced "raises" or raised or thickened portions 16*d* on the strip 16*b* of ribbon like material or flat lanyard, or variable width portions 16*e* of the strip 16*b* of ribbon like material or flat lanyard, when passing though the opening at the top of the card 12 will result in a moderate sensation of stop and go as one pulls down on the card 12.

The above embodiment can also be covered by a film of plastic protective sheathing to better protect the invention.

In still another embodiment similar to that the described above and representatively depicted by way of example only in FIGS. 2A-2D, the lanyard 16, which typically is in the form of a string 16*a*, extends from near the top of the card 12, through the upper hole 12*a* and extends along the back side of the card 12 and out the lower aperture 12*b* to the front of the card. There is a pivotable arm 30 having two parallel members saddling the card 12 and joined at an apex 30*c* that is pivotably attached near a side edge of the card 12 near the middle of a vertical length of the card 12. The member 30 saddles the card 12 with one arm 30*a*,30*b* on each side of the card 12. The back side arm 30*a*, typically near the tip of the arm 30*a*, is attached at an intermediate location along the lanyard portion 16*a* running down the back side of the card 12. As the card 12 is pulled down, the arms 30*a*, 30*b* move up and vice-versa. The arm 30*b* on the front face of the card 12 points to the indicia 22, 24, 26 on the card 12 similar to the indicia described in the aforementioned embodiment above. The indicia 22, 24, 26 can be optionally located to form a half-moon dial face if desired.

Figures 3A, 3B:
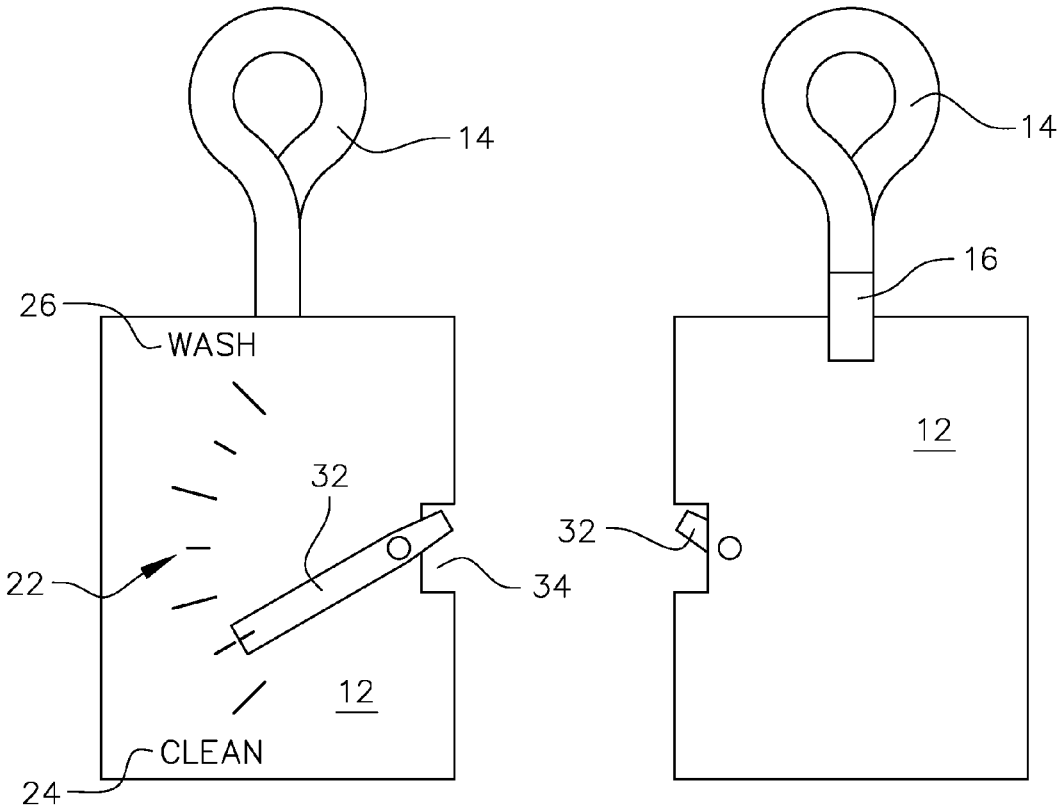
FIG. 3A is a depiction by way of example only of another embodiment of the invention using an arm that is pivotably operated manually to point to designated indicia.
FIG. 3B is a depiction of the back side of FIG. 3A.

In another embodiment similar to those described above and generally depicted by example only in FIGS. 3A-3B, the garment clean indicator comprises a planar member 12, with a loop 14 formed from a lanyard attached near an upper edge of the planar member 12. The formed loop 14 is for use in hanging the device from a hanger 20; an arm 32 being pivotable attached to the planar member 12 and manually operable; and as above, the planar member 12 has garment worn indicia 22 thereon representative of number of times a garment 18 associated with the garment clean indicator has been worn, has garment cleaning needed indicia 26 near the top edge representatively communicating to a user that said associated garment 18 is ready to be cleaned and further has cleaned garment indicia 24 near the bottom edge representatively communicating to the user that the associated garment 18 is clean and ready for wear. The pivotable arm 32 serves as a means for indicating a wear status of the garment by being manually turned to point to a desired indicia 22,24,26. The arm 32 is attached to the card 12 in such a way that there is sufficient compression to ensure that it remains in a designated position. A notched portion 34 of the card can optionally be provided with a small segment of the arm 32 extending beyond the arm pivot point extending into the notched area and the arm 32 could then be manipulated by rotating the end of the arm 32 extending into the notched area. If a protective plastic sheathing (not shown) is used, the manual operation of the pivoting arm 32 is simply done by manually moving the small segment of the arm 32 on the other side of the pivot point from a segment opening in the side of the protective sheathing.

Figures 4A, 4B:
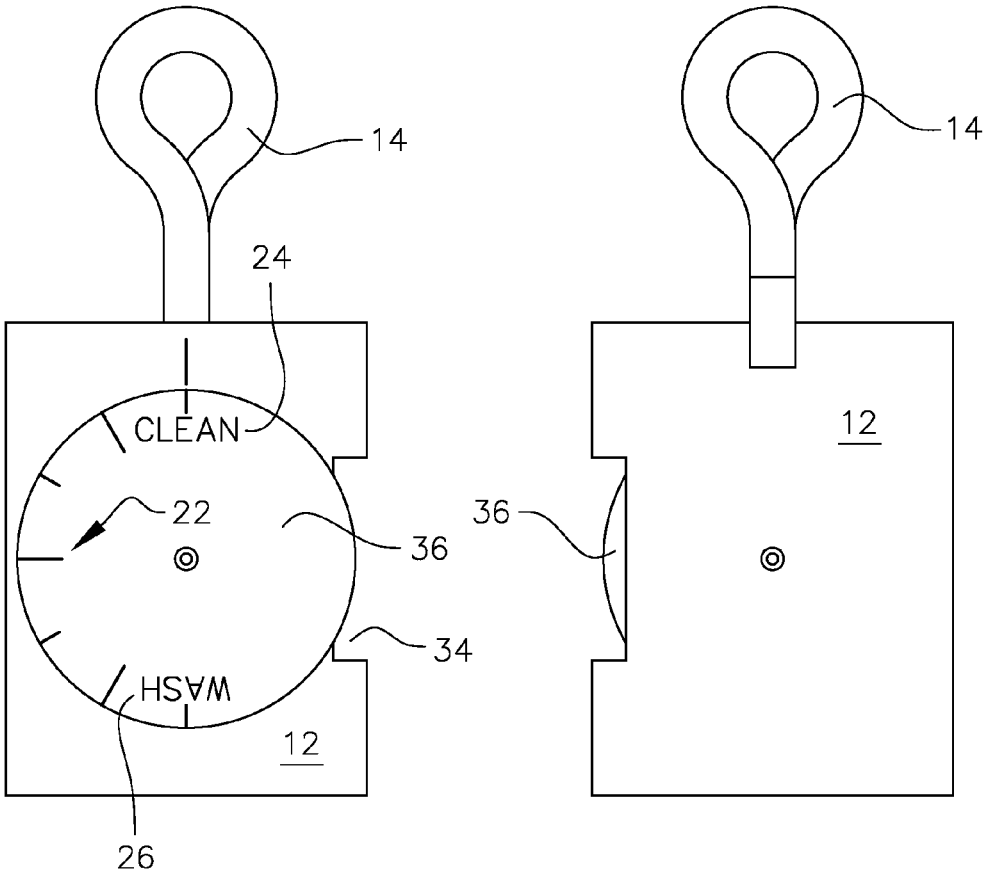
FIG. 4A is a depiction by way of example only of another embodiment of the invention using a rotatable dial face overlying the front face of the underlying card.
FIG. 4B is a depiction of the back side of FIG. 4A.
Figure 5A:
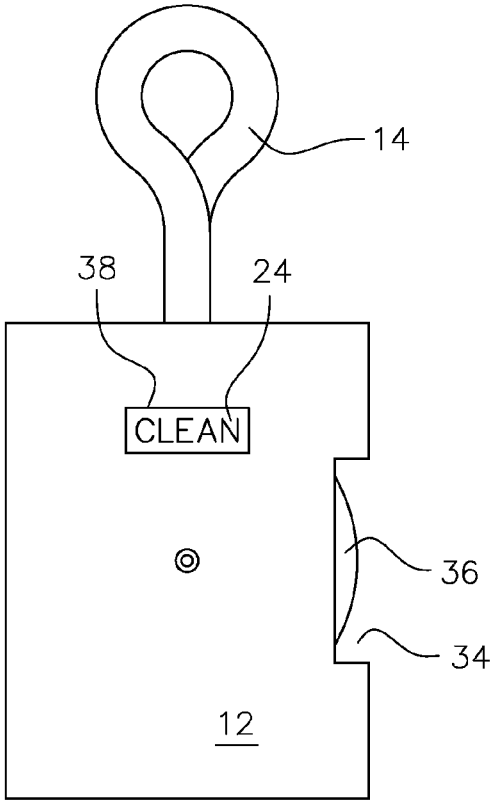
FIG. 5A is a depiction by way of example only of another embodiment of the invention using a rotatable dial face similar to the embodiment of FIG. 4A except the dial face now is in an underlying relationship to the card.
Figure 5B:
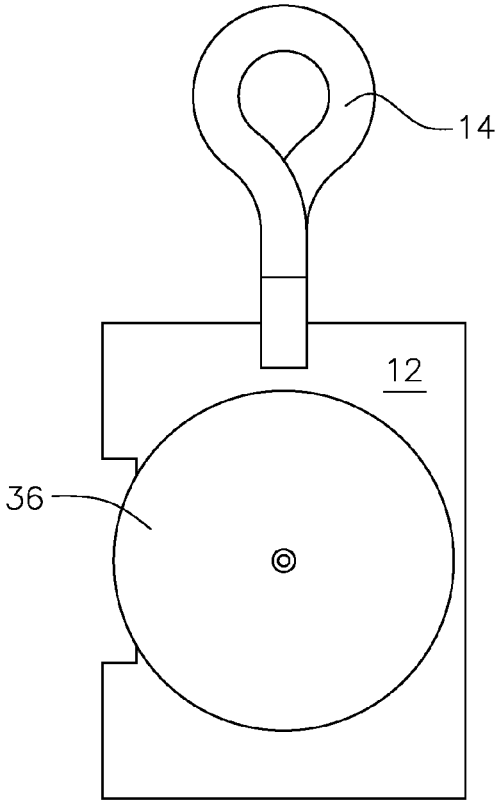
FIG. 5B is a depiction of the back side of FIG. 5A.

In another embodiment of the present invention generally depicted by way of examples only in FIGS. 4A-4B and a similar reversed arrangement of this embodiment depicted in FIGS. 5A-5B, the garment clean indicator comprises a planar member 12 having a loop 14 formed from a lanyard attached near an upper edge of the planar member 12 for use in hanging the device from a hanger 20. The planar member has a notched portion 34 along an intermediate side edge location of the planar member 12. As shown in FIGS. 4A-4B, a circular dial face 36 overlies a front side surface of the planar member 12 and rotatably attaches at a center of the dial face 36 to the planar member 12. Alternatively, as shown in FIGS. 5A-5B, the dial face 36 may be in an underlying relationship to the planar member 12. The dial face 36 is manually operable by rotating it. The dial face has garment worn indicia 22 thereon representative of number of times a garment associated with the garment clean indicator has been worn, has garment cleaning needed indicia 26 representatively communicating to a user that the associated garment is ready to be cleaned and further has cleaned garment indicia 24 representatively communicating to the user that the associated garment is clean and ready for wear. The pivotable dial face 36 serves as a means for indicating a wear status of the garment by being manually turned to point a desired indicia 22,24,26 toward the notched portion 34. In the FIGS. 5A-5B embodiment, the indicia 22,24,26 can be visible in the window area created by the notch portion 34 or cut out window 38.

If a protective plastic sheathing (not shown) is used, the manual operation of the pivoting dial face 36 is simply done by manually moving the outer edge of the dial face 36 extending within the area of the notched portion 34 and having that extended part of the dial face 36 protrude somewhat through an opening in the side of the protective sheathing.

Figure 6A:
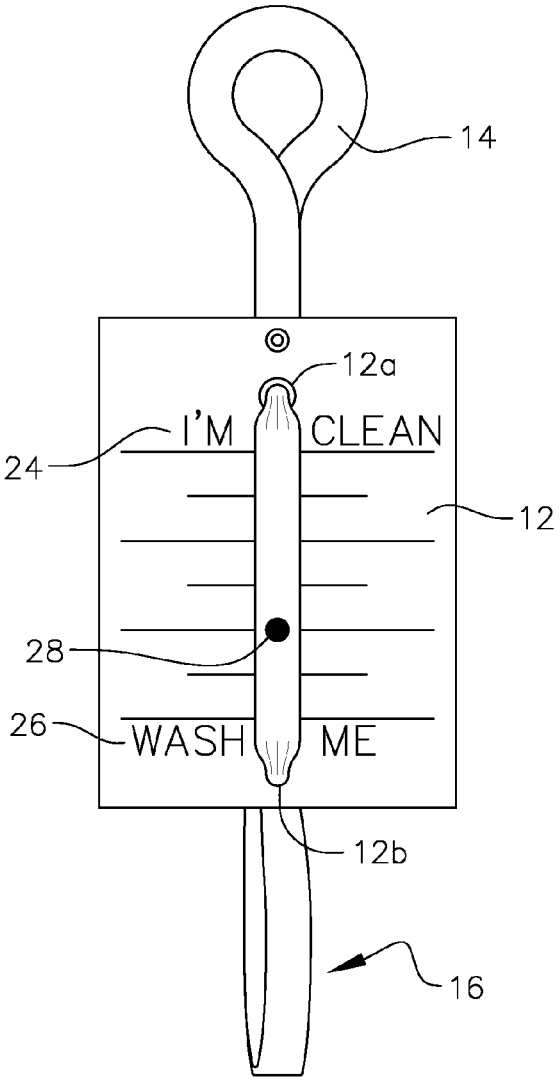
FIG. 6A is a depiction by way of example only of another embodiment of the invention that is the reverse of the FIG. 1A invention in that the card is stationary and the lanyard or ribbon is snaked through the upper and lower apertures on the card and the front and back portions of the ribbon are pulled as appropriate.
Figure 6B:
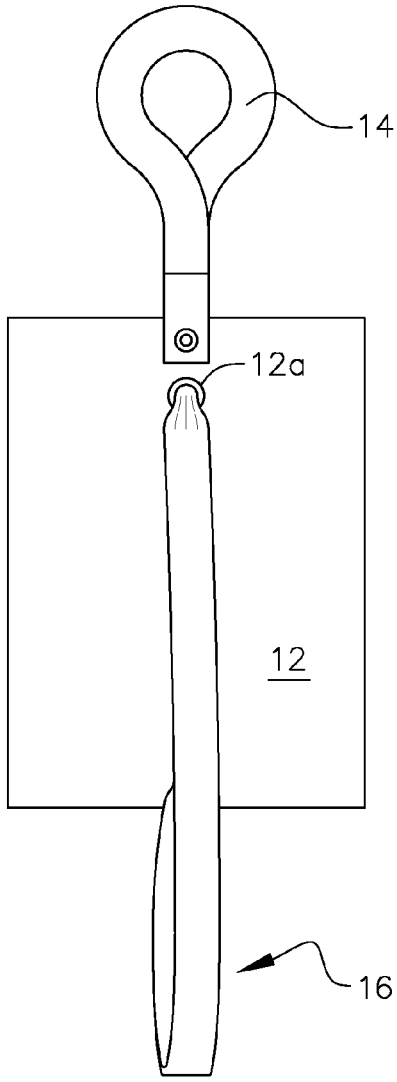
FIG. 6B is a depiction of the back side of FIG. 6A.

In still another embodiment depicted representationally by way of example only in FIGS. 6A-6B, is a depiction of an invention that operates in a reverse way to that of the invention of FIG. 1A in that the card 12 is stationary and the lanyard or ribbon 16 is snaked through the upper and lower apertures 12*a*,12*b* on the card 12 in a continuous loop configuration. The front and back portions of the lanyard or ribbon 16 are pulled as appropriate to align a reference mark 28 with the desired indicia 22,24,26. Although not shown in FIGS. 6A-6B, it is understood that the features depicted in FIGS. 1D-1F may be incorporated with the invention of FIGS. 6A-6B, in particular, the spaced-apart raised or thickened portions 16*d* on the surface of the generally flat surface portion or spaced-apart width variations in thickness 16*e* of the generally flat surface portion, wherein as the lanyard 16 is pulled and the generally flat surface portion passes through the upper and lower apertures 12*a*,12*b*, a sensation of stop and go is achieved.

All of the above embodiments can also be covered by a film of plastic protective sheathing to better protect the invention.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A garment cleanliness indicating device comprising:

a planar member, said planar member having an upper aperture located near a top edge of said planar member and a lower aperture located near a bottom edge of said planar member;

a flexible lanyard having a generally flat surface portion that extends from near said top edge of said planar member through said upper aperture and downwardly along a front side and through said lower aperture of said planar member, said lanyard further extending downwardly a predetermined length below said bottom edge of said planar member;

said planar member having garment worn indicia comprising a plurality of spaced-apart horizontal lines, with a lowest line of said horizontal lines having indicia noting that a garment is clean and a highest line of said horizontal lines having indicia noting that the garment needs to be washed or cleaned;

the lanyard having an integrally imbedded mark thereon; and a loop portion formed above said planar member for use in hanging said device from a hanger, said loop portion being integrally continuous to said lanyard.

2. The device according to claim 1, further comprising spaced-apart raised or thickened portions on a surface of said generally flat surface portion or spaced-apart width variations in thickness of said generally flat surface portion, wherein as said planar member is pulled along said generally flat surface portion and said generally flat surface portion passes through said upper aperture, a sensation of stop and go is achieved.

3. The device according to claim 1, wherein said indicia noting that the garment needs to be washed or cleaned comprises textual or symbolic indicia or a combination of said textual or symbolic indicia.

4. The device according to claim 1, wherein said indicia noting that said garment is clean comprises textual or symbolic indicia or a combination of said textual or symbolic indicia.

5. The device according to claim 1, wherein the lanyard is formed in a continuous loop.

* * * * *